US010766118B2

(12) United States Patent
Nakata et al.

(10) Patent No.: US 10,766,118 B2
(45) Date of Patent: Sep. 8, 2020

(54) EDGE PROCESSING DEVICE FOR MOLDED POWDER COMPACT AND EDGE PROCESSING METHOD FOR MOLDED POWDER COMPACT

(71) Applicant: Hitachi Metals, Ltd., Tokyo (JP)

(72) Inventors: Shinichi Nakata, Tokyo (JP); Kazunori Nishimura, Tokyo (JP); Katsumasa Yamasaki, Tottori (JP)

(73) Assignee: HITACHI METALS, LTD., Tokyo (JP)

( * ) Notice: Subject to any disclaimer, the term of this patent is extended or adjusted under 35 U.S.C. 154(b) by 325 days.

(21) Appl. No.: 15/770,270

(22) PCT Filed: Sep. 28, 2016

(86) PCT No.: PCT/JP2016/078559

§ 371 (c)(1),
(2) Date: Apr. 23, 2018

(87) PCT Pub. No.: WO2017/073228

PCT Pub. Date: May 4, 2017

(65) Prior Publication Data

US 2018/0311786 A1 Nov. 1, 2018

(30) Foreign Application Priority Data

Oct. 26, 2015 (JP) ..... 2015-210262

(51) Int. Cl.
*B24B 41/06* (2012.01)
*B24B 29/00* (2006.01)
(Continued)

(52) U.S. Cl.
CPC ..... *B24B 41/06* (2013.01); *B24B 9/00* (2013.01); *B24B 9/002* (2013.01);
(Continued)

(58) Field of Classification Search
CPC ..... B24B 41/06; B24B 41/02; B24B 9/00; B24B 9/002; B24B 29/00; B24B 29/005; B24B 27/0069; B24B 27/0076
(Continued)

(56) References Cited

U.S. PATENT DOCUMENTS 2,887,702 A * 5/1959 Freitag ..... H02G 1/1285 15/23
4,308,630 A * 1/1982 Schmidt ..... B23Q 11/08 15/104.03
(Continued)

FOREIGN PATENT DOCUMENTS

GB 2069892 A * 9/1981 ..... B21D 19/005
JP 05-069301 A 3/1993
(Continued)

OTHER PUBLICATIONS

International Preliminary Report on Patentability with a Translation of Written Opinion issued from the International Bureau in counterpart International Application No. PCT/JP2016/078559, dated May 11, 2018.
(Continued)

*Primary Examiner* — George B Nguyen
(74) *Attorney, Agent, or Firm* — Sughrue Mion, PLLC

(57) ABSTRACT

An edge processing device includes: conveying means that convey a molded powder compact, a first rotating tool disposed on one side and a second rotating tool disposed on the other side and rotating in a direction identical to a direction the first rotating tool rotates. The first rotating tool contacts from an upstream side with a first corner portion between one side surface of a processing target portion of the molded powder compact and a rear surface of the processing target portion. The second rotating tool contacts from a downstream side with a second corner portion between the other side surface of the processing target
(Continued)

portion and a front surface of the processing target portion. The second rotating tool faces the first rotating tool with the conveying path therebetween, and is positionally displaced to the downstream side with respect to the first rotating tool.

12 Claims, 5 Drawing Sheets

(51) Int. Cl.
*H01F 41/02* (2006.01)
*B24B 9/00* (2006.01)
*B24B 27/00* (2006.01)

(52) U.S. Cl.
CPC ..... *B24B 27/0069* (2013.01); *B24B 27/0076* (2013.01); *B24B 29/00* (2013.01); *B24B 29/005* (2013.01); *H01F 41/02* (2013.01)

(58) Field of Classification Search
USPC ..... 451/367
See application file for complete search history.

(56) References Cited

U.S. PATENT DOCUMENTS 4,630,407 A * 12/1986 Rhodes ..... B24B 7/20 144/361
4,827,676 A * 5/1989 Kindermann ..... B24B 9/00 451/194
5,065,651 A * 11/1991 Amey ..... B24B 9/00 451/247
5,609,512 A * 3/1997 Holmes ..... B24B 3/463 451/210
5,658,189 A * 8/1997 Kagamida ..... B24B 9/065 451/194
5,700,179 A * 12/1997 Hasegawa ..... B24B 7/06 451/41
5,868,603 A * 2/1999 Allaire ..... B24B 9/10 451/29
6,439,969 B1 * 8/2002 Koma ..... H01L 23/544 451/41
7,001,249 B1 * 2/2006 Pride ..... B24B 9/102 451/190
7,621,799 B2 * 11/2009 Sakairi ..... H01L 21/02024 451/299
2002/0006771 A1 * 1/2002 Bavelloni ..... B24B 41/04 451/65
2006/0089086 A1 * 4/2006 Pedersen ..... B24B 9/18 451/8

FOREIGN PATENT DOCUMENTS

JP 06-260357 A 9/1994
JP 2005-125470 A 5/2005
JP 2005-212026 A 8/2005
JP 2006-247768 A 9/2006
JP 2007-090482 A 4/2007
JP 2010-214554 A 9/2010
JP 2016-039373 A 3/2016

OTHER PUBLICATIONS

International Search Report of PCT/JP2016/078559 dated Nov. 15, 2016 [PCT/ISA/210].

* cited by examiner (a)

(b)

(a)

(b)

EDGE PROCESSING DEVICE FOR MOLDED POWDER COMPACT AND EDGE PROCESSING METHOD FOR MOLDED POWDER COMPACT

CROSS REFERENCE TO RELATED APPLICATIONS

This application is a National Stage of International Application No. PCT/JP2016/078559, filed Sep. 28, 2016, claiming priority based on Japanese Patent Application No. 2015-210262, filed Oct. 26, 2015.

TECHNICAL FIELD

The present invention relates to an edge processing device and an edge processing method, for chamfering and burring corner portions of a molded powder compact.

BACKGROUND ART

A product that is obtained by carrying out a predetermined treatment to a molded powder compact manufactured by compressing magnetic powder is commonly known. Examples of such a product include magnetic cores (metal powder cores and ferrite cores) included in coiled components such as inductors, transformers, and chokes. Such magnetic cores are produced in such a manner that a molded powder compact is manufactured by compressing ferrite or metal magnetic powder, and then the molded powder compact is annealed and sintered by carrying out a heat treatment.

Further, a drum-shaped molded powder compact in which a shaft is provided between a pair of flanges is known as molded powder compact. A drum-type magnetic core (drum core) obtained by heat treating the drum-shaped molded powder compact, along with a coil wound around the shaft, constitutes a coiled component described above. Such a molded powder compact is manufactured by carrying out machine processing to cut a molded powder compact having a simple shape such as a circular cylinder or a rectangular solid (cf. Patent Document 1). In recent years, however, various attempts have been made in order to reduce processing by near-net-shape forming.

FIG. 9 shows a cross-section of a mold that is used for near-net-shape forming of a molded powder compact. With this, a molded powder compact 1 having a shaft 13 between a pair of flanges 11, 12 as shown in FIG. 1 is provided. The mold includes a pair of punches 91 that face each other in a pressure direction (an up-down direction in FIG. 9), and tubular dies 92 that are disposed on both side of the punches. Each of the punches 91 is provided with a flange forming portion 93 and a shaft forming portion 94. Tip end portions 94*a* of the shaft forming portion 94 are formed flat so as to ensure their thickness. This also applies to tip end portions of the flange forming portion 93. This is because there is a concern, for example, for damages due to poor strength when the tip end portions are pointed.

However, when the molded powder compact 1 is manufactured using the mold described above, corner portions 13A-13D of the shaft 13 have an angular shape as shown in FIG. 1, and therefore it is necessary to carry out chamfering in order not to damage a coil when winding. Further, even if chamfering is not necessary, there is a case in which it is necessary to remove burrs occurring at the corner portions 13A-13D. In particular, magnetic powder made from a soft and highly malleable metal such as pure iron and magnetic powder with fine grain diameter easily get into gaps between the punches and the dies to produce burrs. In view of the above circumstances, it is necessary to carry out treatments, such as chamfering and burring (hereinafter referred to as edge processing), to corner portions of a molded powder compact.

PRIOR ART DOCUMENTS

Patent Documents

Patent Document 1: JP-A-H06-260357
Patent Document 2: JP-A-2007-90482
Patent Document 3: JP-A-2005-212026
Patent Document 4: JP-A-2010-214554
Patent Document 5: JP-A-2006-247768

SUMMARY OF THE INVENTION

Problems to be Solved by the Invention

Patent Document 1 describes a technique for cutting a square-shaped winding core portion into a circular shape by rotating a chip core between a pair of grindstones. As described above, this is a technique relating to cutting work for forming the winding core portion into a circular shape, and does not relate to edge processing to corner portions of a molded powder compact.

Patent Documents 2-4 describe a technique for burring using a tool such as a roller and a rotating brush. However, as the molded powder compact is generally lightweight, and easily pushed out to a downstream side due to a contact with a rotating tool, there is a case in which edge processing may not be carried out appropriately without appropriate contact time being provided. Nevertheless, if the molded powder compact is held too tightly in order to prevent undesirably being pushed out, the molded powder compact may involve cracking.

Patent Document 5 describes a technique for processing end surfaces of a glass substrate using a plurality of grindstones disposed on both sides of a conveying belt in the width direction. However, this technique neither relate to edge processing to corner portions of a molded powder compact, nor suggest solution for the above stated problem.

The present invention is made in view of the above circumstances, and an object of the present invention is to provide a device and a method for carrying out edge processing to corner portions of a molded powder compact.

Means for Solving the Problems

The present invention provides an edge processing device for a molded powder compact, the device comprising conveying means that convey a molded powder compact along a predetermined conveying path, a first rotating tool disposed on one side in an intersecting direction intersecting with a conveying direction, and a second rotating tool disposed on the other side in the intersecting direction, and rotating in a direction identical to a direction the first rotating tool rotates, wherein the first rotating tool is configured so as to be able to be brought into contact from an upstream side with a first corner portion between one side surface of a processing target portion of the molded powder compact and a rear surface of the processing target portion, the second rotating tool is configured so as to be able to be brought into contact from a downstream side with a second corner portion between the other side surface of the processing target portion and a front surface of the processing target portion, and the second rotating tool faces the first rotating tool with the conveying path therebetween, and is positionally displaced to the downstream side with respect to the first rotating tool.

According to this device, when the first rotating tool processes the first corner portion, the second rotating tool also processes the second corner portion, and therefore a force by which the first rotating tool pushes the molded powder compact out toward the downstream side and a force by which the second rotating tool pushes the molded powder compact out toward the upstream side act at the same time. In addition, the first corner portion and the second corner portion are disposed substantially diagonally regarding the processing target portion, these forces act in a balanced manner. Therefore, the molded powder compact may not be pushed undesirably toward the downstream side due to the first rotating tool being in contact, and contact time in which the first rotating tool is in contact with the corner portion may be ensured. As a result, it is possible to appropriately carry out edge processing to the corner portion of the molded powder compact.

On the other hand, in a configuration in which the second rotating tool is positionally displaced to the upstream side with respect to the first rotating tool, or in which the second rotating tool is not positionally displaced with respect to first rotating tool to the downstream side or to the upstream side, it is difficult to cause the first corner portion and the second corner portion to exert the push-put force and the push-back force at the same time. In this case, when the first rotating tool processes the first corner portion, the molded powder compact can be easily pushed toward the downstream side due to contact with the first rotating tool, and if this reduces the contact time in which the first rotating tool is in contact with the first corner portion, edge processing to the first corner portion may not be appropriately carried out.

In the edge processing device, it is preferable to further comprise a third rotating tool disposed on the other side in the intersecting direction, and rotating in a direction opposite from the direction the first rotating tool rotates, and a fourth rotating tool disposed on the one side in the intersecting direction, and rotating in a direction identical to the direction the third rotating tool rotates, wherein the third rotating tool is configured so as to be able to be brought into contact from the upstream side with a third corner portion between the other side surface of the processing target portion and the rear surface of the processing target portion, the fourth rotating tool is configured so as to be able to be brought into contact from the downstream side with a fourth corner portion between the one side surface of the processing target portion and the front surface of the processing target portion, and the fourth rotating tool faces the third rotating tool with the conveying path therebetween, and is positionally displaced to the downstream side with respect to the third rotating tool.

In this case, when the third rotating tool processes the third corner portion, the fourth rotating tool also processes the fourth corner portion, and therefore a force by which the third rotating tool pushes the molded powder compact out toward the downstream side and a force by which the fourth rotating tool pushes the molded powder compact out toward the upstream side act at the same time. In addition, the third corner portion and the fourth corner portion are disposed substantially diagonally regarding the processing target portion, these forces act in a balanced manner. Thus, in the same manner as described above, contact time in which the third rotating tool is in contact with the corner portion of the molded powder compact may be ensured, and it is possible to appropriately carry out edge processing to the four corner portions.

For each of the first and the second rotating tool, a rotating brush may be used that rotates about a rotating shaft extending along a direction intersecting with both of the conveying direction and the intersecting direction. Similarly, for each of the third and the fourth rotating tool, a rotating brush may be used that rotates about a rotating shaft extending along a direction intersecting with both of the conveying direction and the intersecting direction.

In the edge processing device, it is preferable that each of the first and the second rotating tool is configured to be displaceable in a direction intersecting with both of the conveying direction and the intersecting direction. With this, the rotating tool may reach ends of the processing target portion to provide superior finishing. From the same reason, it is preferable that the third and the fourth rotating tools are configured displaceably in the direction intersecting both with the conveying direction and the intersecting direction.

In the edge processing device, it is preferable that the conveying means is provided with a restricting surface that faces, from the upstream side, a portion of the molded powder compact excluding the processing target portion. With this, along with improved effect by the positional relation among the rotating tools described above, edge processing can be appropriately carried out to the corner portions of the molded powder compact.

In the edge processing device, it is preferable that above the conveying means, a guiding surface for guiding a top surface of the molded powder compact is provided. With this, it is possible to prevent the molded powder compact from being lifted while being conveyed, and along with improved effect by the positional relation among the rotating tools described above, edge processing can be appropriately carried out to the corner portions of the molded powder compact.

In the edge processing device, it is preferable that a restricting surface is provided, the restricting surface facing, from the intersecting direction, a portion of the molded powder compact excluding the processing target portion. With this, along with improved effect by the positional relation among the rotating tools described above, edge processing can be appropriately carried out to the corner portions of the molded powder compact.

The present invention provides an edge processing method for a molded powder compact, the method comprising a conveying step for conveying a molded powder compact along a predetermined conveying path, a first processing step for processing a first corner portion by bringing a first rotating tool into contact from an upstream side with the first corner portion between one side surface of a processing target portion of the molded powder compact and a rear surface of the processing target portion, and a second processing step for processing a second corner portion by bringing a second rotating tool into contact from a downstream side with the second corner portion between the other side surface of the processing target portion and a front surface of the processing target portion, wherein the second rotating tool is positionally displaced to the downstream side with respect to the first rotating tool, and the second corner portion is processed by the second rotating tool when the first corner portion is processed by the first rotating tool.

According to this method, when the first corner portion is processed by the first rotating tool, the second corner portion is also processed by the second rotating tool, and therefore a force by which the first rotating tool pushes the molded powder compact out toward the downstream side and a force by which the second rotating tool pushes the molded powder compact out toward the upstream side act at the same time. In addition, the first corner portion and the second corner portion are disposed substantially diagonally regarding the processing target portion, these forces act in a balanced manner. Therefore, the molded powder compact may not be pushed undesirably toward the downstream side due to the first rotating tool being in contact, and contact time in which the first rotating tool is in contact with the corner portion may be ensured. As a result, it is possible to appropriately carry out edge processing to the corner portion of the molded powder compact.

In the edge processing method, it is preferable to further comprise a third processing step for processing a third corner portion by bringing a third rotating tool into contact from the upstream side with the third corner portion between the other side surface of the processing target portion and the rear surface of the processing target portion, and a fourth processing step for processing a fourth corner portion by bringing a fourth rotating tool into contact from the downstream side with the fourth corner portion between the one side surface of the processing target portion and the front surface of the processing target portion, wherein the fourth rotating tool is positionally displaced to the downstream side with respect to the third rotating tool, and the fourth corner portion is processed by the fourth rotating tool when the third corner portion is processed by the third rotating tool.

In this case, when the third corner portion is processed by the third rotating tool, the fourth corner portion is also processed by the fourth rotating tool, and therefore a force by which the third rotating tool pushes the molded powder compact out toward the downstream side and a force by which the fourth rotating tool pushes the molded powder compact out toward the upstream side act at the same time. In addition, the third corner portion and the fourth corner portion are disposed substantially diagonally regarding the processing target portion, these forces act in a balanced manner. Thus, in the same manner as described above, contact time in which the third rotating tool is in contact with the corner portion of the molded powder compact may be ensured, and it is possible to appropriately carry out edge processing to the four corner portions.

In the edge processing method, it is preferable to process the first and the second corner portion while the first and the second rotating tool are displaced in an extending direction of the processing target portion. With this, the rotating tool may reach ends of the processing target portion to provide superior finishing. From the same reason, it is preferable to process the third and the fourth corner portion while the third and the fourth rotating tool are displaced in an extending direction of the processing target portion.

In the edge processing method, it is preferable to restrict movement of the molded powder compact to the upstream side when being conveyed, by bringing a restricting surface into contact from the upstream side with a portion of the molded powder compact excluding the processing target portion. With this, along with improved effect by the positional relation among the rotating tools described above, edge processing can be appropriately carried out to the corner portions of the molded powder compact.

In the edge processing method, it is preferable to restrict movement in an intersecting direction or rotation of the molded powder compact when being conveyed, by bringing a restricting surface into contact from the intersecting direction with a portion of the molded powder compact excluding the processing target portion, the intersecting direction intersecting with a conveying direction. With this, along with improved effect by the positional relation among the rotating tools described above, edge processing can be appropriately carried out to the corner portions of the molded powder compact.

MODE FOR CARRYING OUT THE INVENTION

An embodiment of the present invention will be explained with reference to the drawings.

Figure 1:
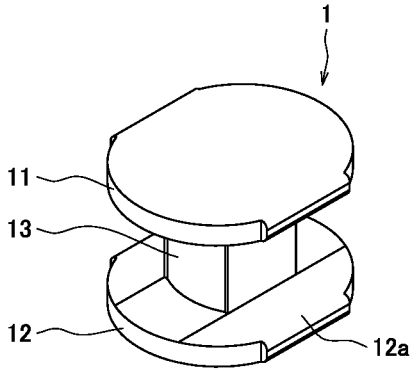
FIG. 1 shows one example of a molded powder compact in (a) a perspective view and (b) a cross-sectional view.
Figure 1:
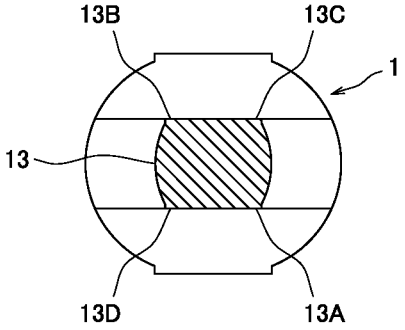
Figure 7:
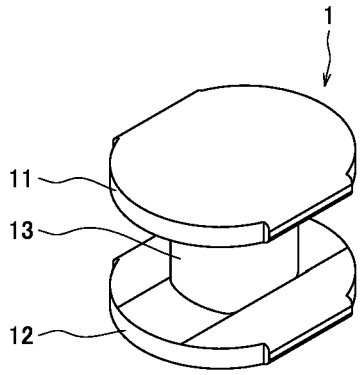
FIG. 7 shows one example of a molded powder compact in (a) a perspective view and (b) a cross-sectional view.
Figure 7:
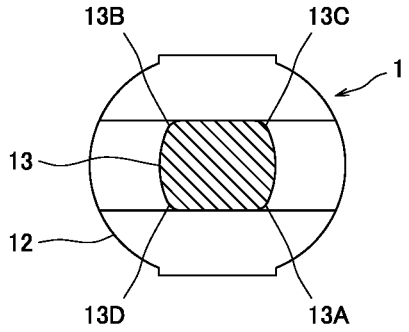

A molded powder compact 1 illustrated in FIG. 1 is in a drum shape in which a shaft 13 having a substantially square-shaped cross-section is provided between a pair of flanges 11, 12. Providing heat treatment to this produces a drum-type magnetic core having the shaft 13 as a winding portion. However, if a magnetic core is manufactured in this state, a coil may be damaged at corner portions of the shaft 13 when winding. In this embodiment, therefore, chamfering as edge processing is carried out to the corner portions of the shaft 13 taking the shaft 13 of the molded powder compact 1 as a processing target portion. Specifically, using an edge processing device illustrated in FIGS. 2-5, each of angular corner portions 13A-13D are cut into curved corner portions 13A-13D as illustrated in FIG. 7.

Figure 3:
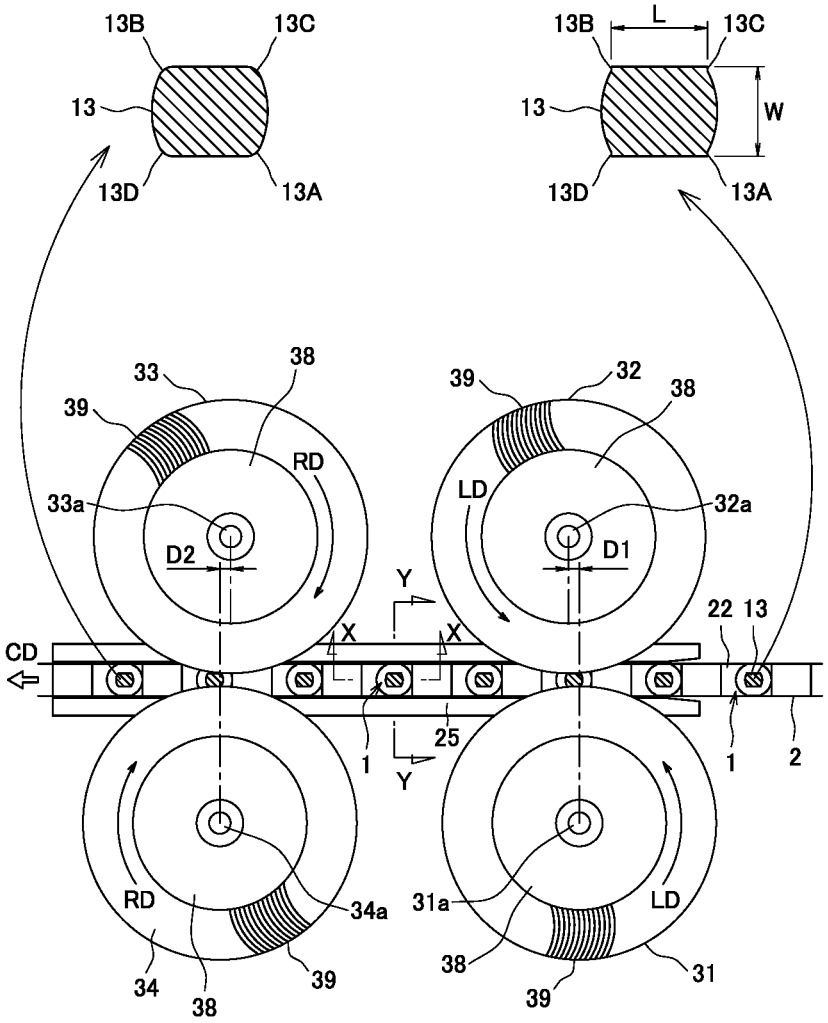
FIG. 3 is a plan view illustrating conveying means and a rotating tool.

The edge processing device includes: a conveying belt 2 that conveys the molded powder compact 1 along a predetermined conveying path (one example of conveying means); a rotating brush 31 as a first rotating tool disposed on one side in an intersecting direction intersecting with a conveying direction CD (a downward side in FIG. 3, in this embodiment); and a rotating brush 32 as a second rotating tool disposed on the other side in the intersecting direction (an upward side in FIG. 3, in this embodiment). In this embodiment, the edge processing device further includes a rotating brush 33 as a third rotating tool disposed on the other side in the intersecting direction, and a rotating brush 34 as a fourth rotating tool disposed on the one side in the intersecting direction. While shown only partially in FIG. 3, bristles 39 of the rotating brushes are provided along an entire circumference.

The conveying belt 2 is configured by an endless toothed belt combined with a pair of pulleys 21, and driven at a predetermined speed by an unillustrated driving device coupled to the pulleys 21. The molded powder compact 1 placed on the conveying belt 2 is conveyed along the predetermined conveying path, and then carried toward the conveying direction CD. In the following, a rearward side of the conveying direction CD (a right side in FIG. 3) is often referred to an upstream side, and a forward side of the conveying direction CD (a left side in FIG. 3) is often referred to a downstream side. In this embodiment, the intersecting direction intersecting with the conveying direction CD corresponds to an across-the-width direction of the conveying belt 2 (the up-down direction in FIG. 3).

Figure 2:
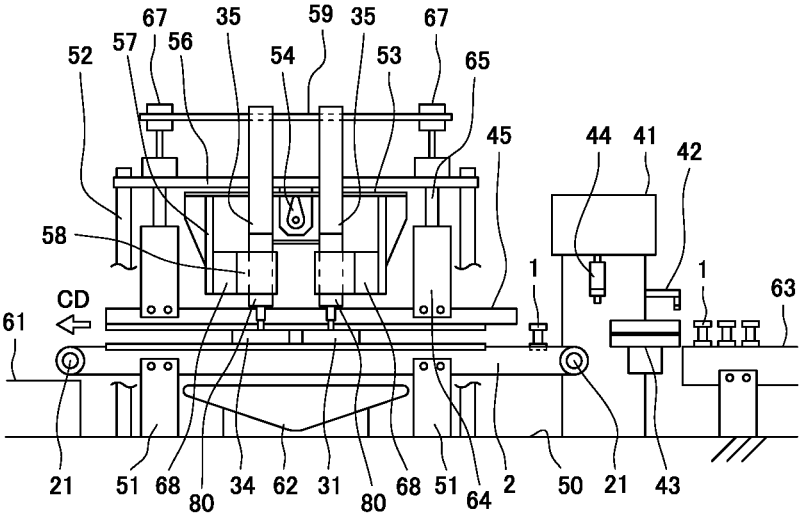
FIG. 2 is a front view schematically illustrating one example of an edge processing device.
Figure 4:
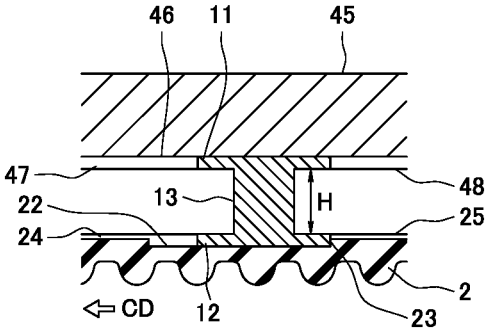
FIG. 4 is a sectional view taken along an arrow X-X in FIG. 3.
Figure 5:
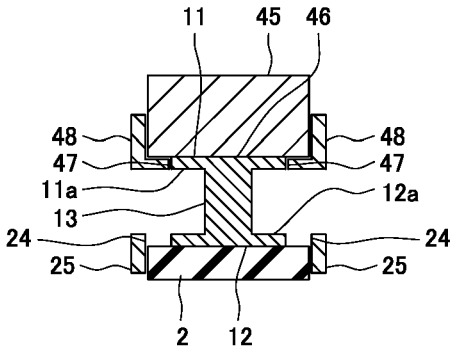
FIG. 5 is a sectional view taken along an arrow Y-Y in FIG. 3.

As illustrated in FIG. 2, there is, on the upstream side of the conveying belt 2, a supply device 41 for supplying the molded powder compact 1 to the conveying belt 2. On the downstream side of the conveying belt 2, there is a collection case 61 for collecting the molded powder compact 1 after processing. Under the conveying belt 2, there is a container 62 for receiving processing scraps occurred in the edge processing. Above the conveying belt 2, as illustrated in FIGS. 4 and 5, there is a guiding surface 46 for guiding over a top surface of the molded powder compact 1. The guiding surface 46 extends along the conveying direction CD, and configured by a bottom surface of a top panel 45 disposed above the conveying belt 2.

The supply device 41 includes a sensor 42 that senses molded powder compacts 1 sequentially or non-sequentially carried from an oscillating feeder 63, a rotating table 43 that separates the molded powder compacts 1 carried from the oscillating feeder 63 on an individual basis, and an arm 44 that picks the molded powder compacts 1 on the rotating table 43 and places the molded powder compacts 1 on the conveying belt 2. The molded powder compacts 1 are aligned to take the same posture before being placed on the rotating table 43, and the molded powder compacts 1 are placed on the conveying belt 2 in a certain posture illustrated in FIGS. 3-5. The conveying belt 2 conveys the molded powder compacts 1 in a state in which shafts 13 are upright.

As illustrated in FIGS. 4 and 5, the guiding surface 46 faces top surfaces of the molded powder compacts 1, and prevents the molded powder compact 1 from being lifted while being conveyed. The guiding surface 46 is disposed at height at which it is slightly in contact with the top surfaces of the molded powder compact 1, or at height at which it is positioned with a fine gap from the top surfaces of the molded powder compact 1. According to such a configuration, as the molded powder compact 1 may not be tightly held from top and bottom, there is only a small possibility that cracking occurs in the molded powder compact 1 (especially, in the flanges 11, 12). On the other hand, the molded powder compact 1 in contact with the rotating brushes can be easily pushed out toward the conveying direction CD, and therefore a configuration described below is useful.

A plan view in FIG. 3 shows the conveying belt 2 and the rotating brushes 31-34 that can be used by this device. The rotating brushes 31-34 rotate respectively about rotating shafts 31*a*-34*a*, and driven by a motor 35 as a driving device (cf. FIG. 2). The rotating shafts 31*a*-34*a* are directed in an up-down direction that intersects with both of the conveying direction CD and the intersecting direction, and extend along an extending direction of the shaft 13 as the processing target portion. The rotating brush 32 rotates in a direction LD which is the same direction as the rotating brush 31 rotates. The rotating direction LD is a counterclockwise direction in FIG. 3. Further, the rotating brush 33 rotates in a rotating direction RD which is an opposite direction from the direction the rotating brush 31 rotates. The rotating direction RD is a clockwise direction in FIG. 3. The rotating brush 34 rotates in the direction RD which is the same direction as the rotating brush 33 rotates.

The rotating brushes 31-34 are disposed between the conveying belt 2 and the top panel 45 in the up-down direction, and their circumferential portions extend above the conveying belt 2. As in FIG. 3, the rotating brush 31 and the rotating brush 32 face each other with the conveying belt 2 therebetween, and an interval between their circumferential portions is set to be smaller than a width W of the shaft 13. As a result, the rotating brushes 31, 32 are brought into contact horizontally with the shaft 13 of the molded powder compact 1 that passes between the rotating brushes 31, 32. The rotating brushes 33, 34 are configured in the same manner.

The rotating brush 31 is configured to able to be brought into contact, from the upstream side, with the corner portion 13A (corresponds to a first corner portion) between one side surface of the shaft 13 as the processing target portion (a lower side in FIG. 3) and a rear surface of the shaft 13. The bristles 39 of the rotating brush 31 extend above the conveying belt 2 from one side of the intersecting direction, and grind the corner portion 13A while moving to the downstream side. Further, the rotating brush 32 is configured to able to be brought into contact, from the downstream side, with the corner portion 13B (corresponds to a second corner portion) between the other side surface of the shaft 13 (an upper side in FIG. 3) and a front surface of the shaft 13. The bristles 39 of the rotating brush 32 extend above the conveying belt 2 from the other side of the intersecting direction, and grind the corner portion 13B while moving to the upstream side.

With this device, the rotating brush 32 faces the rotating brush 31 with the conveying path (that is, the conveying belt 2) therebetween, and is positionally displaced to the downstream side with respect to the rotating brush 31, so that while the rotating brush 31 processes (chamfer in this embodiment) the corner portion 13A, the rotating brush 32 processes (chamfer in this embodiment) the corner portion 13B. A positional displacement amount D1 is a distance between the rotating shafts 31*a*, 32*a* in the conveying direction CD, and set to be an amount allowing time duration for processing the corner portion 13A and the corner portion 13B at the same time. Further, as the rotating brushes 31, 32 face each other, the positional displacement amount D1 is set to be an amount that does not exceed a diameter of the rotating brushes 31, 32.

The positional displacement amount D1 is not particularly limited as long as the above described effects are exerted, and is set, for example, to be 10% to 300% of a length L of the shaft 13, and, more narrowly, 50% to 200% of the length L. The length L is measured as a distance between the corner portion 13A and the corner portion 13B in the conveying direction CD. In one specific example, it is possible to chamfer a molded powder compact having 4 mm of the length L and a different molded powder compact having 3 mm of the length L in an appropriate manner, using a device in which the positional displacement amount D1 (and a positional displacement amount D2 described later) is set to 3 mm.

Therefore, an edge processing method using this device includes: a conveying step for conveying the molded powder compact 1 along the predetermined conveying path; a first processing step for processing the corner portion 13A by bringing the rotating brush 31 into contact with the corner portion 13A from the upstream side; and a second processing step for processing the corner portion 13B by bringing the rotating brush 32 into contact with the corner portion 13B from the downstream side. Further, the rotating brush 32 is positionally displaced to the downstream side with respect to the rotating brush 31, and the corner portion 13B is processed by the rotating brush 32 when the corner portion 13A is processed by the rotating brush 31.

By the rotating brushes 31, 32 disposed in this manner processing the corner portions 13A, 13B, when the corner portion 13A and the corner portion 13B are processed, a force with which the rotating brush 31 pushes the molded powder compact 1 to the downstream side is exerted at the same time as a force with which the rotating brush 32 pushes the molded powder compact 1 to the upstream side. Furthermore, as the corner portion 13A and the corner portion 13B are positioned substantially diagonally in a cross-section of the shaft 13 as the processing target portion, these forces act in a balanced manner. Therefore, the molded powder compact 1 may not be pushed undesirably toward the downstream side due to the rotating brush 31 being in contact, and contact time in which the rotating brush 31 is in contact with the corner portion 13A may be ensured. Moreover, it is possible to prevent contact with the rotating brush 32 from pushing the molded powder compact 1 back to the upstream side.

The rotating brush 33 is configured so as to be able to be brought into contact, from the upstream side, with the corner portion 13C (corresponds to a third corner portion) between the other side surface of the shaft 13 as the processing target portion and the rear surface of the shaft 13. Similarly to the rotating brush 31 described above, the rotating brush 33 grinds the corner portion 13C in the process of moving to the downstream side above the conveying belt 2. Further, the rotating brush 34 is configured so as to be able to be brought into contact, from the downstream side, with the corner portion 13D (corresponds to a fourth corner portion) between the one side surface of the shaft 13 and the front surface of the shaft 13. Similarly to the rotating brush 32 described above, the rotating brush 34 grinds the corner portion 13D in the process of moving to the upstream side above the conveying belt 2.

The rotating brush 34 faces the rotating brush 33 with the conveying path (that is, the conveying belt 2) therebetween, and is positionally displaced to the downstream side with respect to the rotating brush 33, so that while the rotating brush 33 processes (chamfer in this embodiment) the corner portion 13C, the rotating brush 34 processes (chamfer in this embodiment) the corner portion 13D. A positional displacement amount D2 is a distance between the rotating shafts 33*a*, 34*a* in the conveying direction CD, and set to be an amount allowing time duration for processing the corner portion 13C and the corner portion 13D at the same time. The positional displacement amount D2 can be as large as the positional displacement amount D1.

Therefore, the edge processing method using this device includes, after the first and the second processing step described above: a third processing step for processing the corner portion 13C by bringing the rotating brush 33 into contact with the corner portion 13C from the upstream side; and a fourth processing step for processing the corner portion 13D by bringing the rotating brush 34 into contact with the corner portion 13D from the downstream side. Further, the rotating brush 34 is positionally displaced to the downstream side with respect to the rotating brush 33, and the corner portion 13D is processed by the rotating brush 34 when the corner portion 13C is processed by the rotating brush 33.

By the rotating brushes 33, 34 disposed in this manner processing the corner portions 13C, 13D, a force with which the rotating brush 33 pushes the molded powder compact 1 to the downstream side is exerted at the same time as a force with which the rotating brush 34 pushes the molded powder compact 1 to the upstream side. Furthermore, as the corner portion 13C and the corner portion 13D are positioned substantially diagonally in a cross-section of the shaft 13 as the processing target portion, these forces act in a balanced manner. Therefore, the molded powder compact 1 may not be pushed undesirably toward the downstream side due to the rotating brush 33 being in contact, and contact time in which the rotating brush 33 is in contact with the corner portion 13C may be ensured. Moreover, it is possible to prevent contact with the rotating brush 34 from pushing the molded powder compact 1 back to the upstream side.

As described above, according to this embodiment, it is possible to carry out chamfering as the edge processing appropriately to the corner portions 13A-13D of the shaft 13 of the molded powder compact 1. With the molded powder compact 1 after the processing, as shown in an enlarged view on a left side of FIG. 3 as well as in FIG. 7, the corner portions 13A-13D of the shaft 13 are in a rounded shape. Therefore, with a magnetic core obtained by carrying out heat treatment to the molded powder compact 1, a coil may not be damaged while winding.

The rotating brushes 31-34 in this embodiment are configured such that the bristles 39 extend radially from a disc-shaped base portion 38 as shown in FIG. 3, and the bristles 39 are curved so as to project in the rotating direction (the rotating direction LD or the rotating direction RD). Therefore, the brushes may easily move in the rotating direction in a state in which the brushes are in contact with the corner portions of the shaft 13, and thus it is advantageous to carry out edge processing. The bristles 39 are made of a resin containing abrasive grains such as alumina, and have a superior abrasive capability to the molded powder compact 1, yet a concern for over-grinding of the corner portions is smaller as compared to metallic brushes. As examples of such rotating brushes, Radial bristle Marguerite disks available from Sumitomo 3M Ltd may be used. Examples of the rotating tool to be used are not limited to this, and may include a rolling brush having bristles made of nylon 6 or nylon containing abrasive grains, and a cotton yarn buffing wheel.

A thickness of the rotating brushes 31-34 (a thickness of the bristles 39) is preferably smaller than a height H of the shaft 13 (cf. FIG. 4) so that the bristles 39 may easily enter between the pair of flanges 11, 12. For example, the thickness of the rotating brushes is set to be smaller than the height H by about 0.5 mm to 1 mm. In this case, however, processing to ends of the shaft 13 may not be sufficient. Therefore, in this embodiment, the corner portions 13A, 13B are processed while the rotating brushes 31, 32 are displaced in the up-down direction, which is the extending direction of the shaft 13. This also applies to the rotating brushes 33, 34.

As illustrated in FIG. 2, this edge processing device is mounted on a working table 50, and the conveying belt 2, the top panel 45, and an upper base member 56 are fixed to the working table 50 via supporting members 51, 52. The top panel 45 is connected to the supporting member 52, on the upstream side and the downstream side in the conveying direction, via a supporting member 64, a connecting portion 65, and the upper base member 56. The top panel 45 is mounted so as to be able to move up and down with respect to the upper base member 56. Further, in the illustrated example, in order to easily make the height of the top panel 45 equal on the upstream side and the downstream side in the conveying direction, a pulley 67 provided at an upper end of the connecting portion 65 on the upstream side and a pulley 67 provided at an upper end of the connecting portion 65 on the downstream side are connected with a belt 59, a rotating operation of a positioning handle attached to the pulley 67 on the upstream side is transmitted to the pulley 67 on the downstream side to synchronize up and down movement of the top panel 45 on the upstream side and on the downstream side. Each of the rotating brushes 31-34 is connected to the motor 35 via a reducer 80. Each of the rotating brushes 31-34 is supported by a supporting member 53 via a fixing member 58 that securely hold the reducer 80, a positioning stage 68, and a connecting member 57. The supporting member 53 is combined with the upper base member 56 connected to the supporting member 52 so as to be able to displace in the up-down direction relative to the upper base member 56. Between the upper base member 56 and the supporting member 53, there is a cam 54 connected to an unillustrated driving device, and in conjunction with rotation of the cam 54, the supporting member 53 moves up and down following an unillustrated guiding pin provided for the upper base member 56. Along with this, the rotating brushes 31-34 also move up and down. Further, it is possible to adjust and determine initial positions of the rotating brushes 31-34 by the positioning stage 68.

As described above, the rotating brushes 31, 32 are configured displaceably within a range defined by the cam 54, in the up-down direction which is the direction intersecting both with the conveying direction CD and the intersecting direction. With this, edge processing may be carried out to ends of the shaft 13 as the processing target portion to provide superior finishing. Further, the rotating brushes 33, 34 are also configured displaceably in the up-down direction. A displacement amount of the rotating brushes 31-34 in the up-down direction (a margin of up-down movement of the supporting member 53) may be adjusted by changing a shape of the cam 54.

In this embodiment, the rotating brushes 31-34 have, but not limited to, the same rotation speed. For example, if a force by which the rotating brushes 31, 33 push the molded powder compact 1 out toward the downstream side is large, and the molded powder compact 1 can slip on the conveying belt 2, such a situation can be resolved by relatively increasing the rotation speed of the rotating brushes 32, 34 facing the rotating brushes 31, 33. Alternatively, due to a different reason, the rotation speed of the rotating brushes 31, 33 may be relatively increased.

As illustrated in FIGS. 3 and 4, the conveying belt 2 is provided with a plurality of depressed portions 22 intermittently along the conveying direction CD, and each of the depressed portions 22 includes the molded powder compact 1. A wall surface of the depressed portions 22 on the upstream side is provided as a restricting surface 23 that faces, from the upstream side, a flange 12 corresponding to a part that is not a processing target portion (the shaft 13) of the molded powder compact 1. In this embodiment, movement of the molded powder compact 1 to the upstream side is restricted while being conveyed, by bringing the restricting surface 23 into contact with the flange 12 of the molded powder compact 1. With this, along with improved effect by the positional relation among the rotating brushes described above, edge processing can be appropriately carried out to the corner portions of the shaft 13 of the molded powder compact 1. Further, by bringing the restricting surface 23 into contact not with the shaft 13 but with the flange 12, it is also possible not to prevent the rotating brushes from being brought into contact with to the shaft 13.

In order to ensure workability when the molded powder compact 1 is placed on the conveying belt 2, the depressed portions 22 are formed to be longer than the flange 12 in the conveying direction CD. For example, when a length of the flange 12 is 10 mm, a length of the depressed portions 22 may be set to be 14 mm. As described above, even in the configuration in which the molded powder compact 1 is placed within the depressed portions 22 is employed, a play is provided in the conveying direction CD between the wall surface of the depressed portions 22 and the molded powder compact 1. Therefore, it is useful to employ the above configuration that prevents the molded powder compact 1 from being undesirably pushed out toward the downstream side.

Preferably, a depth of the depressed portions 22 is set to be equal to or smaller than a thickness of the flange 12. For example, when the thickness of the flange 12 is 1 mm, the depth of the depressed portions 22 may be set to 0.6 mm. With this, as a top surface 12*a* of the flange 12 is positioned at the same height as or higher than a surface of the conveying belt 2, the rotating brush may not be prevented from being brought into contact with a lower portion of the shaft 13.

As illustrated in FIG. 5, restricting surfaces 24 that face the flange 12 corresponding to a part that is not a processing target portion of the molded powder compact 1 are provided on the both side of the across-the-width direction of the conveying belt 2 corresponding to the intersecting direction (right-left direction in FIG. 5). The restricting surfaces 24 are provided by side surfaces of guiding members 25 disposed adjacent to the conveying belt 2. In this embodiment, movement in the intersecting direction and rotation of the molded powder compact 1 are restricted while being conveyed, by restricting surfaces 47 that will be later described. However, the restricting surfaces 24 may be used in place of or in addition to this configuration. Preferably, upper ends of the restricting surfaces 24 are positioned at the same height as or lower than the top surface 12*a* of the flange 12, and with this, the rotating brush may not be prevented from being brought into contact with the lower portion of the shaft 13.

Above the conveying belt 2, there are provided the restricting surfaces 47 that face, from the intersecting direction, a flange 11 corresponding to a part that is not a processing target portion of the molded powder compact 1. The restricting surfaces 47 are provided by side surfaces of guiding members 48 disposed adjacent to the top panel 45. In this embodiment, movement in the intersecting direction or rotation of the molded powder compact 1 are restricted while being conveyed, by bringing the restricting surfaces 47 into contact with the flange 11 of the molded powder compact 1 from the intersecting direction. With this, along with improved effect by the positional relation among the rotating brushes described above, edge processing can be appropriately carried out to the corner portions of the shaft 13 of the molded powder compact 1. Preferably, lower ends of the restricting surfaces 47 are positioned at the same height as or higher than a lower surface 11*a* of the flange 11, and with this, the rotating brush may not be prevented from being brought into contact with an upper portion of the shaft 13.

In this embodiment, the example in which chamfering is carried out to the corner portions of the shaft 13 of the molded powder compact 1. However, burring as edge processing may be carried out in place of chamfering. Alternatively, it is possible to carry out chamfering and burring at the same time.

Figure 6:
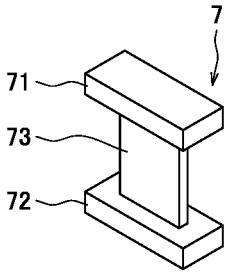
FIG. 6 is a perspective view illustrating another example of the molded powder compact.

A molded powder compact as a target of edge processing may not be limited to the shape as shown in FIG. 1, and may take a different shape. For example, in a molded powder compact 7 illustrated in FIG. 6, a plate-like shaft 73 provided between a pair of flanges 71, 72 are taken as a processing target portion, and edge processing is carried out to corner portions of the shaft 73. The flanges may include cutout. It should be noted that a molded powder compact to which edge processing is carried out is not limited to the shape in which flanges are provided on both side of a shaft, and may have a shape in which a flange only on one side of a shaft.

The present invention is not limited to the embodiment mentioned above, but can be improved and modified variously within the scope of the present invention. Therefore, for example, in a case in which a burr occurs only at a specific corner portion such as the first corner portion, it is possible to employ a configuration in which the third and the fourth rotating tools are not provided.

In the embodiment described above, the example in which the molded powder compact is conveyed while the shaft is upright is described. However, a molded powder compact may be conveyed while the shaft is laid down. Further, in the embodiment described above, the example in which the shaft of the molded powder compact is a processing target portion is described. However, apart other than the shaft may be taken as a processing target portion, or it is possible to process a molded powder compact without a shaft.

Figure 8:
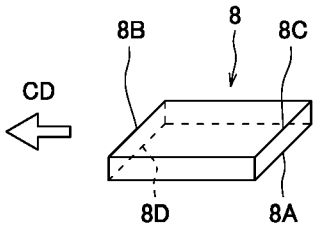
FIG. 8 is a perspective view illustrating another example of the molded powder compact.
Figure 9:
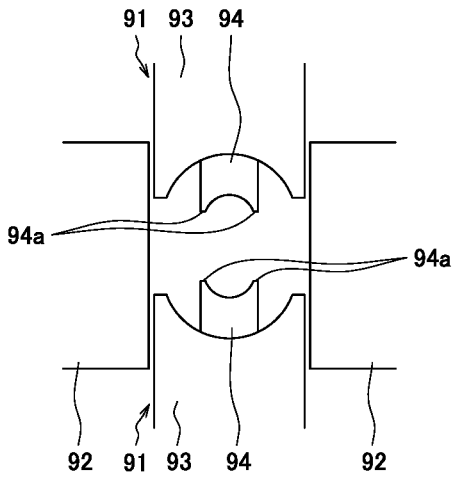
FIG. 9 is a sectional view illustrating one example of a mold for molding the molded powder compact.

In the embodiment described above, the example is shown in which the intersecting direction that intersects with the conveying direction is, but not limited to, horizontal. For example, as shown in FIG. 8, in a configuration in which the extending direction of a processing target portion is directed horizontally as in a case in which a flat-plated molded powder compact 8 is conveyed in the conveying direction CD, and edge processing (e.g., burring) is carry out to corner portions 8A-8D taking the molded powder compact 8 as a whole as a processing target portion, it is useful to employ a configuration in which the intersecting direction that intersects with the conveying direction may be directed vertically, and rotating brushes having a rotating shaft in a horizontal direction may be provided above and under the conveying path.

The configuration of the conveying belt may not be limited to the above embodiments. Further, in the embodiment described above, the example in which the conveying belt is used as the conveying means is described. However, as long as a molded powder compact may be conveyed along a predetermined conveying path, the conveying means may not be particularly limited, and a conveying chain or a different mechanism may be employed.

DESCRIPTION OF REFERENCE SIGNS

1 Molded powder compact
2 Conveying belt (one example of conveying means)
11 Flange
12 Flange
13 Shaft (one example of processing target portion)
13A Corner portion (first corner portion)
13B Corner portion (second corner portion)
13C Corner portion (third corner portion)
13D Corner portion (fourth corner portion)
22 Depressed portion
23 Restricting surface
31 Rotating brush (one example of first rotating tool)
32 Rotating brush (one example of second rotating tool)
33 Rotating brush (one example of third rotating tool)
34 Rotating brush (one example of fourth rotating tool)
41 Supply device
45 Top panel
46 Guiding surface

The invention claimed is:

1. An edge processing device for a molded powder compact, the device comprising:

conveying means that convey a molded powder compact along a predetermined conveying path;

a first rotating tool disposed on one side in an intersecting direction intersecting with a conveying direction; and a second rotating tool disposed on the other side in the intersecting direction, and rotating in a direction identical to a direction the first rotating tool rotates, wherein the first rotating tool is configured so as to be able to be brought into contact from an upstream side with a first corner portion between one side surface of a processing target portion of the molded powder compact and a rear surface of the processing target portion, the second rotating tool is configured so as to be able to be brought into contact from a downstream side with a second corner portion between the other side surface of the processing target portion and a front surface of the processing target portion, and the second rotating tool faces the first rotating tool with the conveying path therebetween, and is positionally displaced to the downstream side with respect to the first rotating tool.

2. The edge processing device for a molded powder compact according to claim 1, further comprising:

a third rotating tool disposed on the other side in the intersecting direction, and rotating in a direction opposite from the direction the first rotating tool rotates; and a fourth rotating tool disposed on the one side in the intersecting direction, and rotating in a direction identical to the direction the third rotating tool rotates, wherein the third rotating tool is configured so as to be able to be brought into contact from the upstream side with a third corner portion between the other side surface of the processing target portion and the rear surface of the processing target portion, the fourth rotating tool is configured so as to be able to be brought into contact from the downstream side with a fourth corner portion between the one side surface of the processing target portion and the front surface of the processing target portion, and the fourth rotating tool faces the third rotating tool with the conveying path therebetween, and is positionally displaced to the downstream side with respect to the third rotating tool.

3. The edge processing device for a molded powder compact according to claim 1, wherein each of the first and the second rotating tool is configured as a rotating brush that rotates about a rotating shaft extending along a direction intersecting with both of the conveying direction and the intersecting direction.

4. The edge processing device for a molded powder compact according to claim 1, wherein each of the first and the second rotating tool is configured to be displaceable in a direction intersecting with both of the conveying direction and the intersecting direction.

5. The edge processing device for a molded powder compact according to claim 1, wherein the conveying means is provided with a restricting surface that faces, from the upstream side, a portion of the molded powder compact excluding the processing target portion.

6. The edge processing device for a molded powder compact according to claim 1, wherein above the conveying means, a guiding surface for guiding a top surface of the molded powder compact is provided.

7. The edge processing device for a molded powder compact according to claim 1, wherein a restricting surface is provided, the restricting surface facing, from the intersecting direction, a portion of the molded powder compact excluding the processing target portion.

8. An edge processing method for a molded powder compact, the method comprising:

a conveying step for conveying a molded powder compact along a predetermined conveying path;

a first processing step for processing a first corner portion by bringing a first rotating tool into contact from an upstream side with the first corner portion between one side surface of a processing target portion of the molded powder compact and a rear surface of the processing target portion; and a second processing step for processing a second corner portion by bringing a second rotating tool into contact from a downstream side with the second corner portion between the other side surface of the processing target portion and a front surface of the processing target portion, wherein the second rotating tool is positionally displaced to the downstream side with respect to the first rotating tool, and the second corner portion is processed by the second rotating tool when the first corner portion is processed by the first rotating tool.

9. The edge processing method for molded powder compact according to claim 8, further comprising:

a third processing step for processing a third corner portion by bringing a third rotating tool into contact from the upstream side with the third corner portion between the other side surface of the processing target portion and the rear surface of the processing target portion; and a fourth processing step for processing a fourth corner portion by bringing a fourth rotating tool into contact from the downstream side with the fourth corner portion between the one side surface of the processing target portion and the front surface of the processing target portion, wherein the fourth rotating tool is positionally displaced to the downstream side with respect to the third rotating tool, and the fourth corner portion is processed by the fourth rotating tool when the third corner portion is processed by the third rotating tool.

10. The edge processing method for molded powder compact according to claim 8, further comprising:

processing the first and the second corner portion while the first and the second rotating tool are displaced in an extending direction of the processing target portion.

11. The edge processing method for molded powder compact according to claim 8, further comprising:

restricting movement of the molded powder compact to the upstream side when being conveyed, by bringing a restricting surface into contact from the upstream side with a portion of the molded powder compact excluding the processing target portion.

12. The edge processing method for molded powder compact according to claim 8, further comprising:

restricting movement in an intersecting direction or rotation of the molded powder compact when being conveyed, by bringing a restricting surface into contact from the intersecting direction with a portion of the molded powder compact excluding the processing target portion, the intersecting direction intersecting with a conveying direction.

* * * * *